US005548858A

United States Patent [19]

Shoa

[11] Patent Number: 5,548,858

[45] Date of Patent: Aug. 27, 1996

[54] INFORMATION EXHIBITING SINGLE USE SLEEPING BAG

[76] Inventor: Yong F. Shoa, 1215 Summit Rd., McLean, Va. 22101

[21] Appl. No.: 426,274

[22] Filed: Apr. 21, 1995

[51] Int. Cl.[6] ..... A47G 9/08

[52] U.S. Cl. ..... 5/413 R; 5/487; 5/922; 5/482

[58] Field of Search ..... 5/413, 487, 417, 5/419, 420, 494, 922, 482, 502; 2/69.5

[56] References Cited

U.S. PATENT DOCUMENTS

| | | | |
|---|---|---|---|
| D. 313,142 | 12/1990 | Truell | 5/419 |
| 1,269,276 | 6/1918 | Harris | 5/485 |
| 1,925,358 | 9/1933 | Wittcoff | 5/419 |
| 2,625,695 | 1/1953 | Nicholson | 5/487 |
| 4,095,299 | 6/1978 | Schweiso | 5/658 |
| 4,197,601 | 4/1980 | Maguire | 5/419 |
| 4,575,884 | 3/1986 | Jamerson et al. | 5/413 |
| 4,977,632 | 12/1990 | Ong | 5/413 |

FOREIGN PATENT DOCUMENTS

| | | | |
|---|---|---|---|
| 2446622 | 9/1980 | France | 5/413 |

*Primary Examiner*—Alexander Grosz
*Attorney, Agent, or Firm*—William F. Hamrock

[57] ABSTRACT

A low cost disposable sleeping bag for use on a bed or cot or other support. The sleeping bag includes opposing single sheets of nonwoven, soft paper forming an envelope, an apron for writing messages, keeping records, locating advertisements or playable amusement games or other desirable information, and an attached pillow case. The sleeping bag provides a comfortable confined sleeping area with a pillow for the user and prevents the user from coming in bodily contact with the bed, cot or support and provides information relevant to the user.

9 Claims, 6 Drawing Sheets

INFORMATION EXHIBITING SINGLE USE SLEEPING BAG

BACKGROUND OF THE INVENTION

1. Field of the Invention

The invention relates to a low cost, disposable sleeping bag and, in particular, to a nonwoven, soft paper single sheet sleeping bag having an information section and with an attached pillow case where the sleeping bag is used on a bed or cot or other support.

2. Description of the Prior Art

Disposable sleeping bags having paper in the structure are known. Many of these sleeping bags include combinations of a number of materials and involve complicated structural procedures which increase the cost of the items. Also, many of these sleeping bags are made to withstand inclement outdoor conditions which necessarily involves increased costs. Thus, the reduced cost to be derived from the use of disposable sleeping bags is negated by making the structure of the sleeping bags too complicated and thus too expensive for only temporary use. There does not appear to be any sleeping bag available in the prior art that encompasses an information section directed to the health, welfare and enjoyment of the user.

A low cost disposable sleeping bag could be used in many areas which do not require that the bag be exposed to inclement outdoor conditions. Such areas would include hospitals, hotels or motels, homes, dormitories, barracks, outdoors in mild weather conditions, and many other areas. Also, there are many situations in which a low cost disposable sleeping bag would be useful. Such situations include when it would be preferable that the user's body be isolated from the bed or cot or soft support. For instance, such situations could exist with patients in hospitals, or with children's over night stay in a residence, or with people staying at hotels or motels wherein there is a lack of suitable sleeping accommodations, or for emergency situations with people housed temporarily in a dormitories or barracks. Thus, there is a need for a disposable sleeping bag that would have a relatively inexpensive cost in order to justify discarding the sleeping bag after one or more uses. The sleeping bag need only be comfortable and provide sufficient protection to the user under mild indoor and outdoor atmospheric conditions.

In many of the above areas where the present low cost sleeping could be used, it would be helpful in many situations to be able to record or display information in some manner attached to the sleeping bag. One area would include hospitals and nursing homes wherein medical records, notes and information relevant to the user patient would be recorded. Another area would include dormitories or barracks wherein it would be appropriate to display emergency directions or other information which would be directed for the user to be aware of. Further areas would include hotels, motels and other commercial establishment wherein it would be appropriate to display advertising of an interesting nature. These are only a few of the many possibilities of establishing immediate information channels available to the user of the present low cost sleeping bag.

It is an object of the invention to provide a low cost sleeping bag which will justify discarding it after one or more uses.

It is another object of the invention to provide a low cost, disposable sleeping bag which is made only of paper.

It is a further object of the invention to provide a low cost, disposable paper sleeping bag which is used on a bed, cot or other support.

It is a further object of the invention to provide a low cost, disposable, paper sleeping bag which isolates the user from the bed, cot or other support.

It is a further object of the invention to provide a low cost, disposable, paper sleeping bag which protects the user in mild indoor and outdoor atmospheric conditions.

It is a further object of the invention to provide a low cost, disposable, paper sleeping bag exhibiting information which is necessary for maintaining the good health, welfare and enjoyment of the user.

Further objects and advantages of the invention will become apparent from the detailed description of the following taken in conjunction with the accompanying drawings.

SUMMARY OF THE INVENTION

Briefly stated, these and other objects are accomplished by constructing a sleeping bag from lightweight, soft, nonwoven paper material which promote safety, softness, warmth and convenience. The sleeping bag includes three sections, the body section, the information section and the pillow case section. The body section is composed of two opposing top and bottom single flat sheets of the nonwoven paper material forming an enclosed foot end portion and open head end portion. The pillow case section is formed from the bottom sheet extending beyond the head end of the sleeping bag where it is folded underneath and secured to the underside of the bottom sheet forming a pillow case open at its two sides for inserting a pillow therein, The information section is formed from the top sheet folded down below the head end to reveal the underside of the top sheet having an area available for keeping records or writing notes or playing games or displaying various information. An advantage of the low cost, disposable sleeping bag is that it is simply and inexpensively constructed and isolates the body of the user from the support upon which it rests. Another advantage of the low cost sleeping bag is making available an informations section relevant to the health, welfare, enjoyment and other well being of the user. Thus, it is an inexpensive sleeping bag for use with a bed, cot other support upon which it rests and disposing of the sleeping bag after one or more uses. The sleeping bag isolates the user's body from the support and is thus advantageously used in hospitals, nursing homes, hotels, motels, barracks, dormitories and other areas as required when it is desired to isolate the user from contacting the bed, cot or other support or just have a low cost, disposable sleeping bag available for use.

BRIEF DESCRIPTION OF THE DRAWINGS

A better understanding of the present invention will be had upon reference to the following detailed description when read in conjunction with the accompanying drawings, wherein like reference characters refer to like parts throughout the several view, and in which.

DETAILED DESCRIPTION OF THE PREFERRED EMBODIMENT

The unique inexpensive lightweight nonwoven paper sleeping bag as disclosed herein is not merely another complicated structured disposable sleeping bag which is overly constructed making it too expensive for a disposable sleeping bag for use under normal conditions. To the contrary, the unique disposable sleeping bag of the present invention is simply constructed for use on a bed or cot or other support and to be used under normal conditions. The present sleeping bag is constructed of lightweight soft nonwoven paper material making it comfortable for sleeping but also so inexpensive that it can be disposed of after one or more uses to satisfy the needs of many institutions, hospitals, nursing homes, shelters, barracks, hotels or motels, private homes, and other areas in need of such an item. A significant advantage of the present sleeping bag over known sleeping bags is its information function. In other words, not only does the present sleeping bag have the qualities of promoting warmth, softness and disposability but it also provides information which, is relevant to the user's health, welfare and enjoyment.

Figure 1:
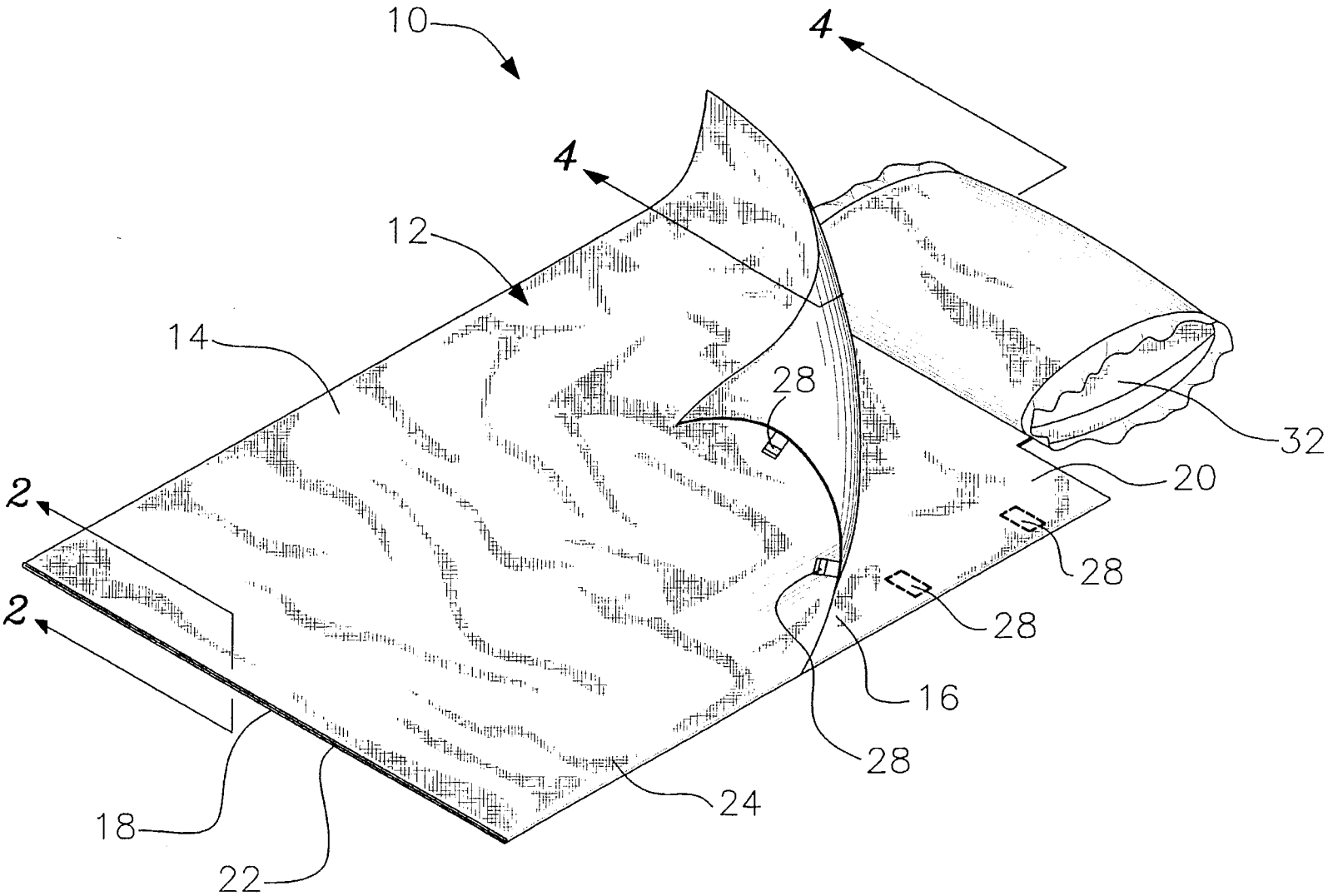
FIG. 1 is a perspective view of a sleeping bag according to a preferred embodiment of the invention.

A preferred embodiment of the invention is shown in FIG. 1 wherein rectangular sleeping bag 10 is depicted. The body section 12 of the sleeping bag includes opposing top sheet 14 and bottom sheet 16 made from two single flat blanks of soft nonwoven paper. Sleeping bag 10 has a closed foot end portion 18 and an open head end portion 20. The edge portions of top sheet 14 and bottom sheet 16 are completely fastened together along their adjacent foot end edges 22 and partway up therefrom along their adjacent side edges 24 to completely enclose that end portion of the sleeping bag.

Figure 2:
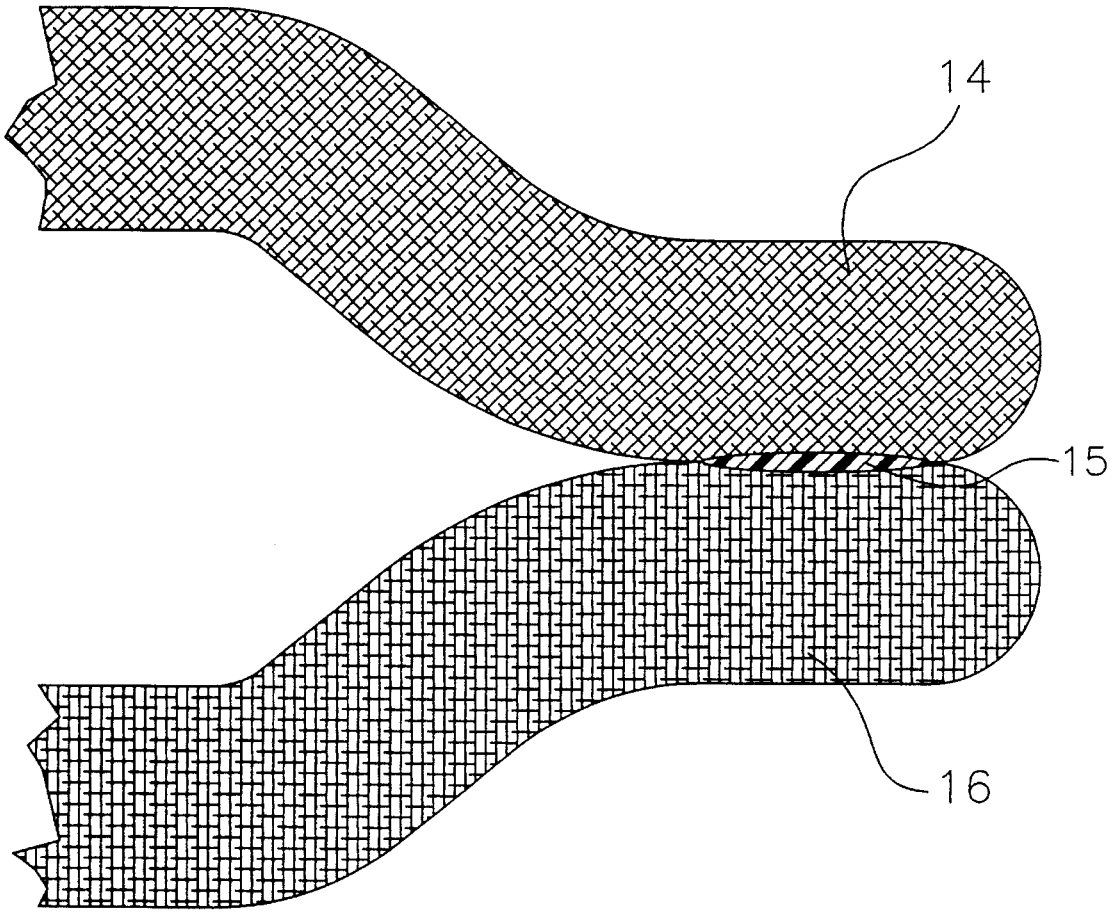
FIG. 2 is a sectional view showing the sealing at the edges.

The adjacent foot end edges 22 and side end edges 24 are fastened together by securing their adjacent peripheral edges together by various methods. Shown in FIG. 2 is one preferred method wherein the adjacent edges are secured by adhesive 15 joining the edges of top sheet 14 and bottom sheet 16 by adhesive and heat as required. Another preferred method of securing the top and bottom sheets together is by turning their adjacent peripheral foot end edges and side end edges 24 inwardly about one quarter of an inch and stitching a continuous tight seam along the edge of the sleeping bag creating a tight seal within this portion of the sleeping bag. The continuous adhesively secured and stitched portion of the sleeping bag retains the body heat of the user while in the bag. Thus, by adhesively securing and stitch-sealing the bag as discussed, this allows the single sheet sleeping bag to be used under most moderate conditions while keeping the user comfortable. Other methods of sealing the bag such as by staples would be permissible also. For instance, another preferred method is for the sleeping bags to be made of only one single rectangular blank of non-woven paper which is heat treated in an assembly line which substantially reduces the cost by eliminating sewing and cutting operations. Top sheet 14 and bottom sheet 16 are releasably secured by adhesive flaps 28 made of flexible plastic such as nylon or similar material. Adhesive flaps 28 are securely attached to top sheet 14 by stitching, adhesive or staples or equivalent securing means and are releasably secured to bottom sheet 16 by adhesive such as a releasable strip or other releasable adhesive means. The adhesive flaps permit opening and closing of top sheet 14 for a person entering into or emerging from the sleeping bag.

Figure 3A:
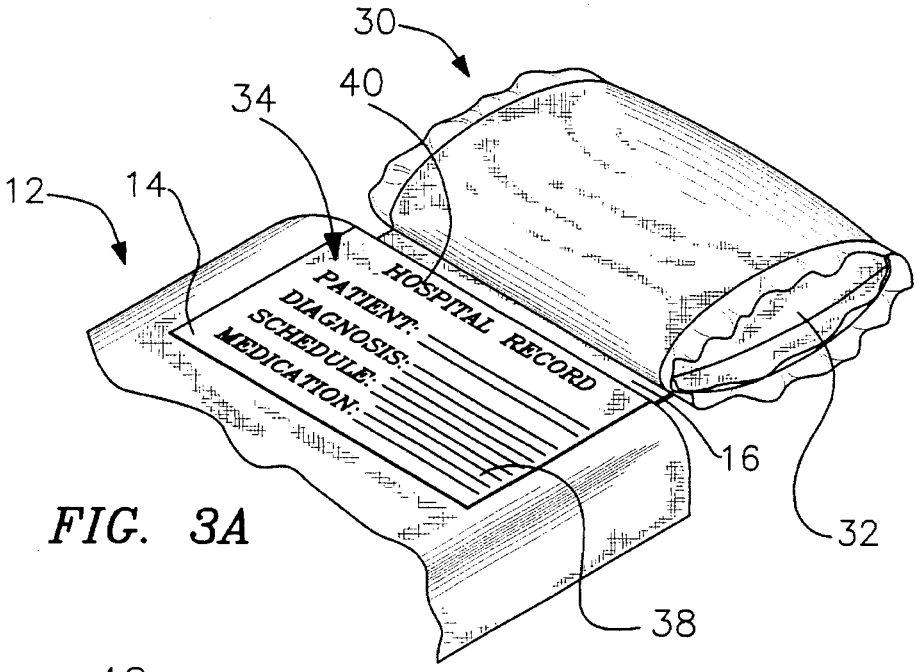
FIGS. 3A, 3B and 3C are sectional views of preferred embodiments of modified information panel sections.
Figure 4:
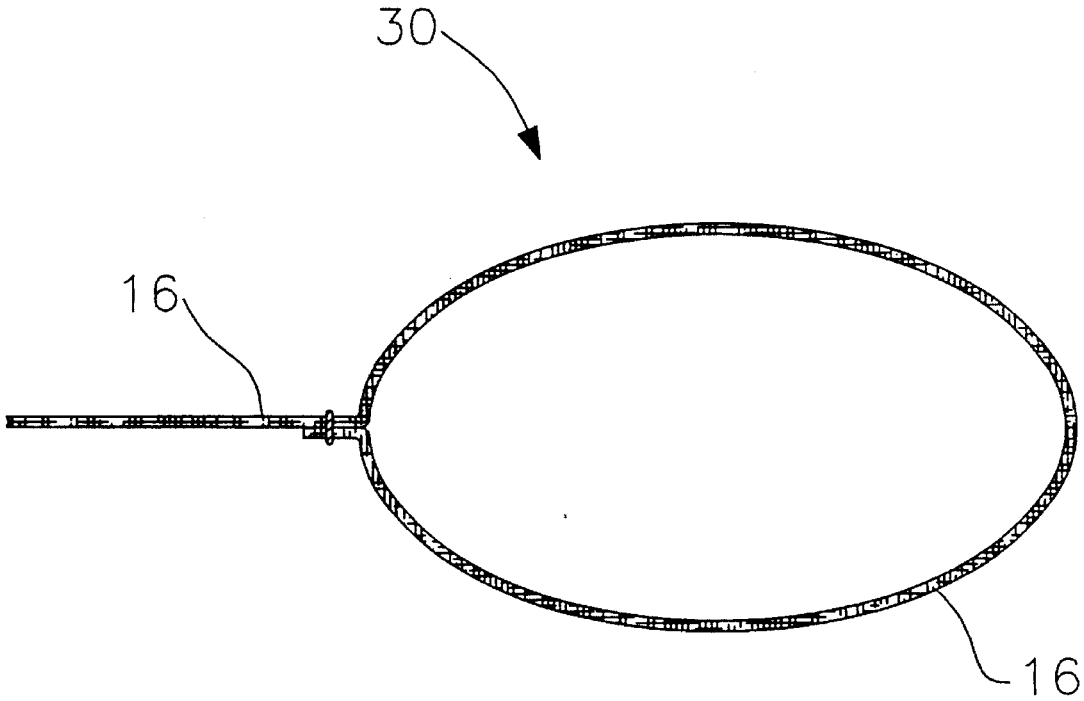
FIG. 4 is a sectional view of the pillow case section.
Figure 5:
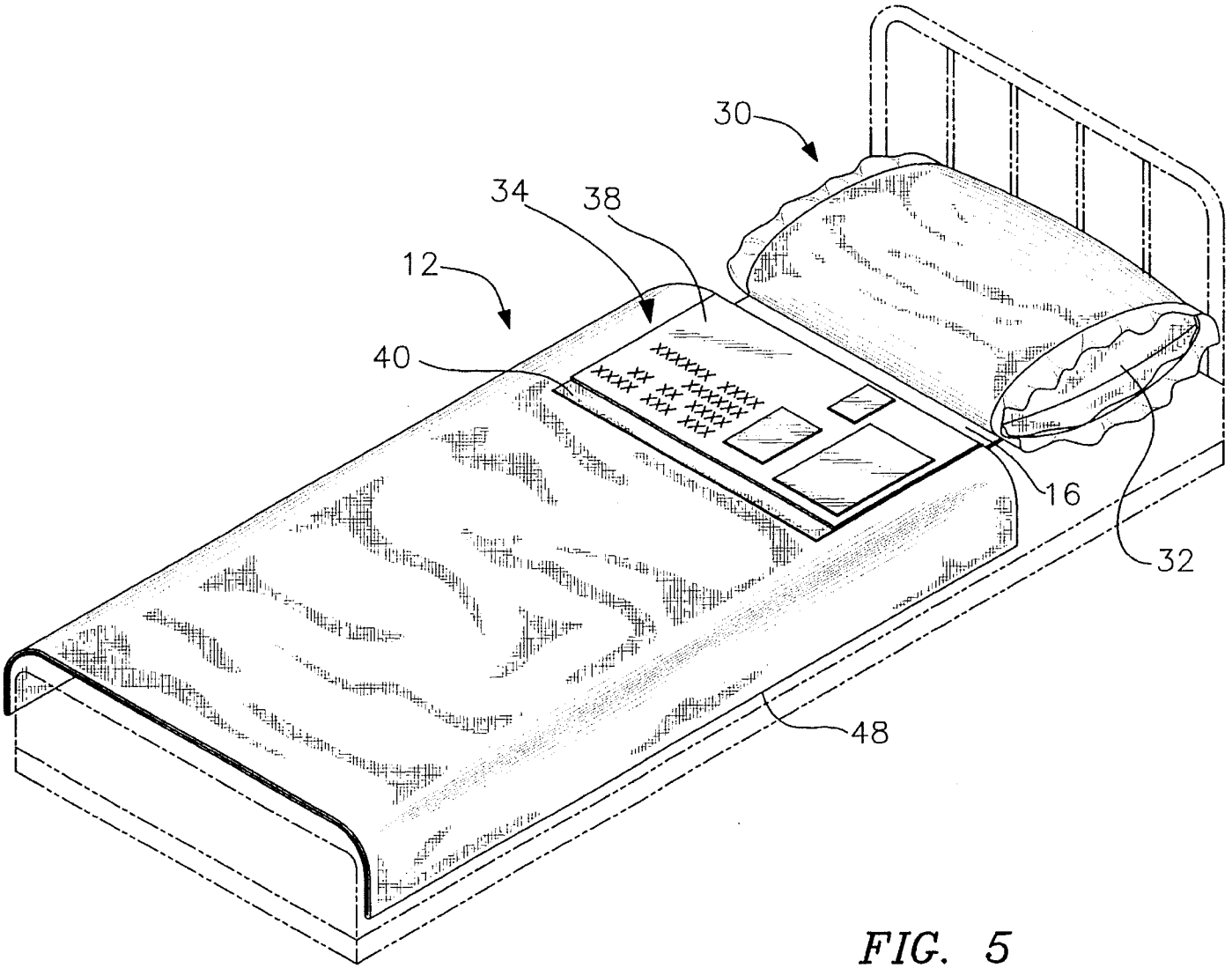
FIG. 5 is a perspective view of a preferred embodiment including natural side edges.

As seen in FIGS. 3A, 4 and 5, pillow case section 30 is formed by folding the extended head end of bottom sheet 16 underneath and securing it to the underside of the bottom sheet by adhesive, stitching or equivalent attachment. Pillow case section 30 is open at both sides allowing a pillow 32 to be inserted into the pillow case section and preventing the pillow from contacting the user's head. Thus, the pillow case section along with the body section 12 completely isolates the user's body from touching a supporting surface or the pillow 32.

Figure 3B:
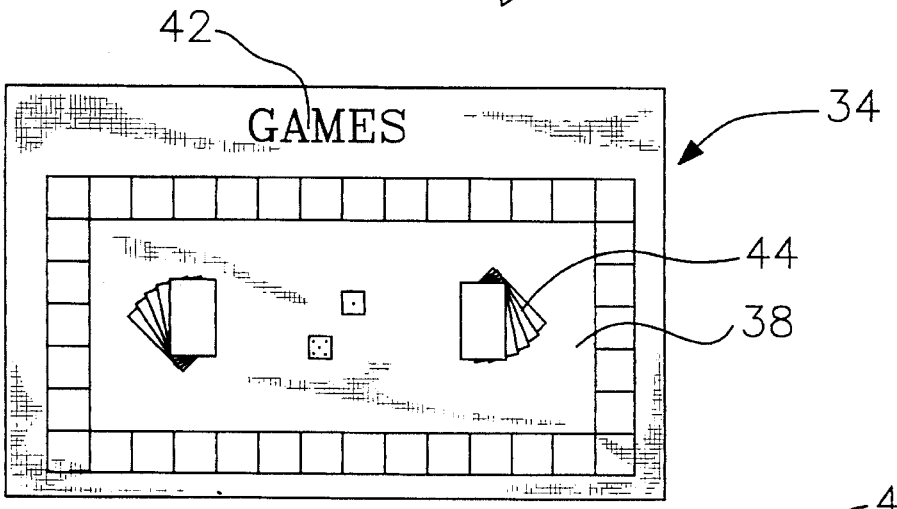
Figure 3C:
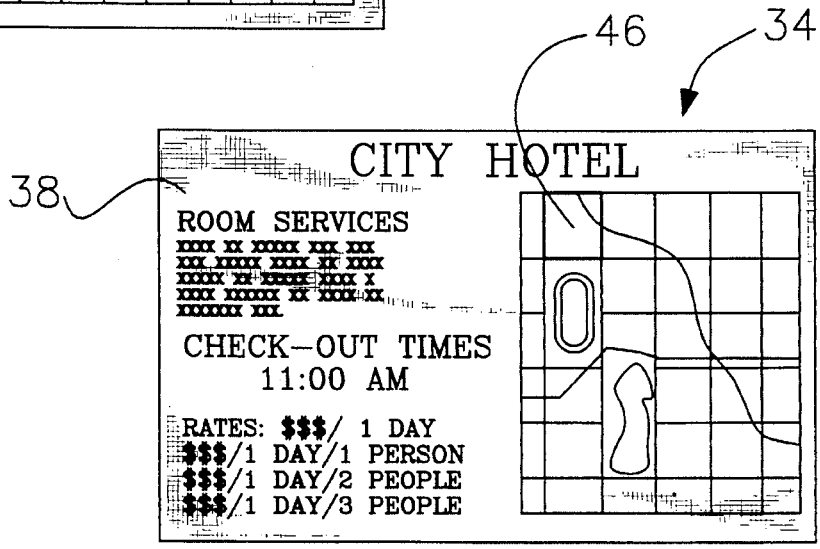
Figure 6:
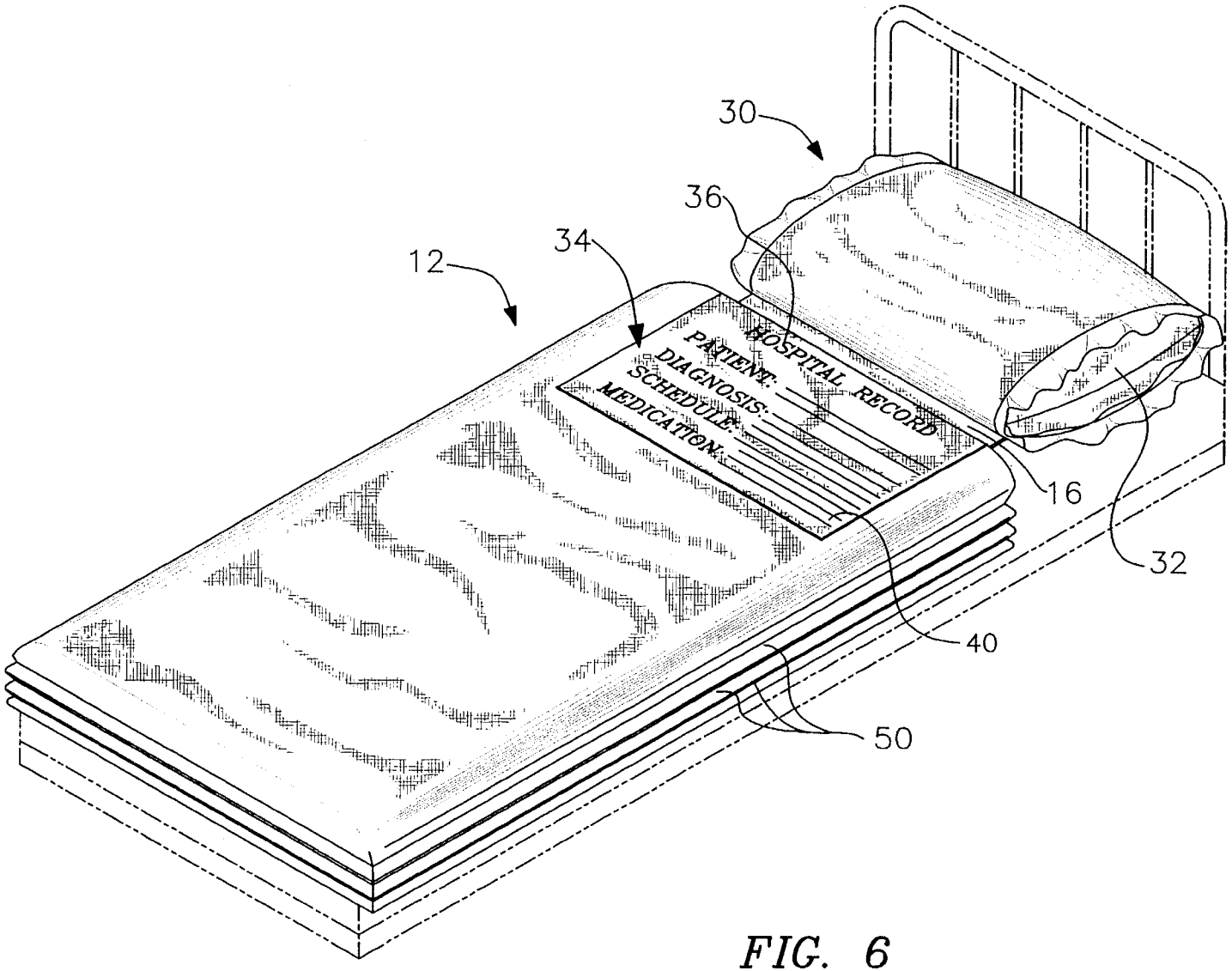
FIG. 6 is a perspective view of a preferred embodiment including ruffled side edges.

FIGS. 3A, 3B, 3C 5 and 6 illustrate various information panels which can be used on the sleeping bag. The information panel section 34 is formed on the head end of top sheet 14. The information panels, for example, can be only information 36 that is imprinted on the top part of top sheet 16 as seen in FIG. 6, or it can be a separate information panel flap 38 attached to the top sheet as seen in FIG. 3A and showing only separate flaps as seen in FIGS. 3B and 3C, or it can be a separate information panel attached to a separate sheet flap 40 which is attached to the top sheet as seen in FIG. 5 o it can also be any one of the above attached to the underside of the top sheet which is exposed when the top sheet is folded down which are not shown. Information panel section 34 may have information such as records, notes, games, advertisements or travel information displayed on its exposed surface or it may have a clear surface available for keeping records, writing notes, playing games or for any other use. Preferred embodiments of the information panels wherein a separate information panel flap 36 is attached illustrated in FIGS. 3, 3B and 3C In the embodiments in FIGS. 3A, 3B and 3C, modified information panels are shown which comprise the separate information panel flap 38 attached to top sheet 14 at the head end and depict some of the various types of information that can be provided in the information panel sections. FIG. 3A depicts a type of medical record 42, FIG. 3B depicts a type of game 44, and FIG. 3C depicts hotel information and small map 46. Modified information panel 38 may be prepared from any firm paper, cardboard or plastic material which will allow the display of various types of information as shown as well as other printed information, written records, advertisements, games, etc. Modified information panel 38 may be attached to top sheet 14 by any conventional means such as stitching, adhesive, staples or equivalent means. Information panel section 34 or modified information panel 38 applied to the present low cost sleeping bag adds an important means for presenting information which has not been available previously in sleeping bags. The information panel allows the present sleeping bag to be used in the many areas under entirely different situations by making available records, notations, advertising and various other information not previously available to sleeping bag users.

A further preferred embodiment of the sleeping bag is seen in FIG. 5 wherein body section 12 includes separate sheet flap 40 attached to the top sheet and natural side edges 48. In this embodiment the top sheet 14 and bottom sheet 16 are completely fastened or integrally joined together along their natural side edged 48 and the sleeping bag is completely enclosed at the foot end and sides and open at the head end.

Another preferred embodiment of the sleeping bag as seen in FIG. 6 represents information section 34 having imprinted information 36 directly on top sheet 16 and body section 12 having ruffled side edges 50. The top sheet 14 and bottom sheet 16 are completely fastened or integrally together along the foot end and side edges wherein the top sheet edges include ruffled surface. In this embodiment the sleeping bag is completely enclosed at the foot end and sides and open at the head end.

The nonwoven soft paper material encompassing the sleeping bag's top sheet 14, bottom sheet 16 and pillow case section 30 provides a comfortable sleeping bag giving protection to the user under mild indoor or outdoor conditions. The nonwoven paper material isolates the user's body from coming in contact with the support upon which it rests such as a bed, cot or other support. It is prepared from inexpensive material making it an inexpensive item which justifies its disposal after limited use. The nonwoven paper material can include various designs to conform the surroundings in which it is being used by hand touching of the nonwoven paper. The colors can be printed by rollerprinting.

Having now described the invention, it will be apparent to one of ordinary skill in the art that many changes and modifications can be made thereto without departing from the spirit and scope of the invention as set forth herein.

What is claimed is:

1. In combination, a lightweight disposable sleeping bag and an information panel section comprising:

a sleeping bag having a closed foot end and an open head end, a body section having opposing top and bottom single sheets, each sheet prepared from a single flat blank of nonwoven soft paper, said top sheet and bottom sheet joined together at their foot end and along their lower side edges by a continuous seal at their adjacent outer edges formed by joining their adjacent peripheral edges together, said top sheet and bottom sheet being releasably joined together, by releasable means, along their upper side edges, said top sheet provided with an information panel section attached thereto, a pillow case section having open sides formed by the bottom sheet at the head end of the sleeping bag said pillow case section being formed by folding the extended bottom sheet underneath and securing it to the underside of the bottom sheet, said seal at said adjacent outer edges conserving body heat and said body section and pillow case section completely insulates a user from contacting a support upon which the sleeping bag rests.

2. The sleeping bag according claim 1 wherein said information panel provides a firm panel attached to the top sheet.

3. The sleeping bag according to claim 1 wherein said information panel contains medical information.

4. The sleeping bag according to claim 1 wherein said information panel contains advertising.

5. The sleeping bag according to claim 1 wherein said information panel contains a playable amusement game.

6. The sleeping bag according to claim 1 wherein said seal at the adjacent outer edges is formed by adhesive or stitching a continuous seal at said outer edges.

7. A sleeping bag according to claim 1 wherein said top sheet and bottom sheet side edges are natural edges.

8. A sleeping according to claim 1 wherein said top sheet and bottom sheet side edges are ruffled edges.

9. In combination a disposable sleeping bag and an information panel according to claim 1 wherein said sleeping bag being prepared from a single rectangular nonwoven paper heat treated at their adjacent outer edges.

* * * * *

UNITED STATES PATENT AND TRADEMARK OFFICE

CERTIFICATE OF CORRECTION

PATENT NO. : 5548858
DATED : August 27, 1996
INVENTOR(S) : Yong Fu Shao

It is certified that error appears in the above-indentified patent and that said Letters Patent is hereby corrected as shown below:

On the front page of the patent, the inventor's last name is incorrectly spelled "SHOA ", it should be - - SHAO - -.

Please issue a corrected patent without charge in lieu of and with like effect as a Certificate of Correction (37CFR1.322).

Submitted herewith is the Patent Grant.

Signed and Sealed this

Twenty-fifth Day of February, 1997

*Attest:*

Bruce Lehman

BRUCE LEHMAN

*Attesting Officer*

*Commissioner of Patents and Trademarks*